US011390067B2

(12) United States Patent
Biancalani et al.

(10) Patent No.: US 11,390,067 B2
(45) Date of Patent: Jul. 19, 2022

(54) PRINTING UNIT WITH INTERCHANGEABLE PRINTING SLEEVE

(71) Applicant: BOBST FIRENZE S.R.L., Campi Bisenzio (IT)

(72) Inventors: Francesco Biancalani, San Casciano Val di Pesa (IT); Federico D'Annunzio, Florence (IT); Ludovico Frati, Siena (IT); Giacomo Maccalli, Lodi (IT); Mauro Maccalli, Lodi (IT)

(73) Assignee: BOBST FIRENZE S.R.L., Campi Bisenzio (IT)

( * ) Notice: Subject to any disclaimer, the term of this patent is extended or adjusted under 35 U.S.C. 154(b) by 24 days.

(21) Appl. No.: 16/498,957

(22) PCT Filed: Apr. 6, 2018

(86) PCT No.: PCT/EP2018/025100
§ 371 (c)(1),
(2) Date: Sep. 27, 2019

(87) PCT Pub. No.: WO2018/184738
PCT Pub. Date: Oct. 11, 2018

(65) Prior Publication Data

US 2021/0086499 A1 Mar. 25, 2021

(30) Foreign Application Priority Data

Apr. 7, 2017 (EP) ..... 17020144

(51) Int. Cl.
*B41F 5/24* (2006.01)
*B41F 13/20* (2006.01)
*B41F 27/10* (2006.01)

(52) U.S. Cl.
CPC ..... *B41F 27/105* (2013.01); *B41F 5/24* (2013.01); *B41F 13/20* (2013.01)

(58) Field of Classification Search
CPC ..... B41F 27/105; B41F 13/34
(Continued)

(56) References Cited

U.S. PATENT DOCUMENTS 5,370,047 A * 12/1994 Compton ..... B41F 5/24 101/216
5,463,950 A 11/1995 Cuir et al.
(Continued)

FOREIGN PATENT DOCUMENTS

CN 1096482 A 12/1994
CN 1197003 A 10/1998
(Continued)

OTHER PUBLICATIONS

International Search Report issued in related PCT/EP2018/025100, dated Jun. 12, 2018 (3 pages).
(Continued)

*Primary Examiner* — Jennifer Bahls
(74) *Attorney, Agent, or Firm* — Bookoff McAndrews, PLLC

(57) ABSTRACT

The present invention discloses a printing unit with an automated sleeve change process. A sleeve can be prepared for the next printing job while the current job is running, thereby reducing the changeover time. Also, the printing unit can handle printing sleeves of very different sizes without any special additional adjustments to be made. The printing unit translates the printing roller and the inking roller on a horizontal line to engage and dis-engage the printing roller. The invention is convenient for large printing sleeves because the sleeve can be slipped over a shaft that remains in the unit. The setup results in a very rigid system, which guarantees an excellent printing quality.

20 Claims, 8 Drawing Sheets

(58) Field of Classification Search
USPC ..... 101/378
See application file for complete search history.

(56) References Cited

U.S. PATENT DOCUMENTS

| | | | | |
|---|---|---|---|---|
| 6,374,731 | B1 * | 4/2002 | Walczak | B41F 7/12 101/142 |
| 6,386,103 | B1 * | 5/2002 | Charette | B41F 27/105 101/375 |
| 9,840,074 | B2 * | 12/2017 | Bastici | B41F 13/20 |
| 2002/0073864 | A1 * | 6/2002 | Kolbe | B41F 5/24 101/425 |
| 2002/0108520 | A1 | 8/2002 | Kolbe et al. | |
| 2008/0141886 | A1 * | 6/2008 | Whitelaw | B41F 13/14 101/484 |
| 2012/0079954 | A1 * | 4/2012 | Westhof | B41F 13/38 101/248 |

FOREIGN PATENT DOCUMENTS

| | | | | |
|---|---|---|---|---|
| CN | 1810503 | A | 8/2006 | |
| CN | 101594995 | A | 12/2009 | |
| CN | 201900779 | U | 7/2011 | |
| CN | 104379351 | A | 2/2015 | |
| CN | 204998106 | U | 1/2016 | |
| CN | 205395401 | U | 7/2016 | |
| CN | 106166895 | A | 11/2016 | |
| CN | 106414075 | A | 2/2017 | |
| DE | 10314297 | B4 | 7/2002 | |
| EP | 0 611 240 | A1 | 8/1994 | |
| EP | 611240 | A1 * | 8/1994 | B41F 13/34 |
| EP | 0769373 | B1 | 1/1999 | |
| EP | 1151862 | A2 * | 11/2001 | B41F 13/20 |
| EP | 1 221 367 | A1 | 7/2002 | |
| EP | 1 285 753 | A1 | 2/2003 | |
| EP | 1318015 | A2 | 6/2003 | |
| WO | WO-2007022896 | A1 * | 3/2007 | B41F 13/44 |
| WO | 2014202255 | A1 | 12/2014 | |
| WO | 2015166409 | A1 | 11/2015 | |

OTHER PUBLICATIONS

Beijing Institute of Printing Technology: "Structure and Principle of Lithographic Printing Machine", cover page, table of contents, and pp. 78-81 (Nov. 1960), and Machine Translation (13 pages).

* cited by examiner

PRINTING UNIT WITH INTERCHANGEABLE PRINTING SLEEVE

CROSS-REFERENCE TO RELATED APPLICATION(S)

This application is a National Stage under 35 U.S.C. § 371 of International Application No. PCT/EP2018/025100, filed on Apr. 6, 2018, which claims priority to European Application No. 17020144.6, filed Apr. 7, 2017, the contents of all of which are incorporated by reference in their entirety.

The present invention relates to a printing unit for a flexographic printing machine. In particular, it relates to a printing unit where the change of the printing sleeve requires little time.

BACKGROUND OF THE INVENTION

At present, in the printing sector, and in particular in the sector of printing labels and flexible wrappings, there exists a need to increase the general efficiency of the printing processes by reducing the printing time and by limiting the waste of material, such as the printing medium.

In particular, the step of changing the printing rollers is one of the most critical steps in the entire printing process since the so-called "job change-over" times constitute downtime, during which the printing process is substantially interrupted. Moreover, the change-over between two different printing jobs generally results in a huge amount of wasted material. The trend in the packaging industry is toward smaller series and faster presses. In this respect, the downtime due to the job change-over becomes more critical.

STATE-OF-THE-ART

Some solutions for automatically changing the printing rollers are known.

DE 10314 297 discloses a varnishing unit with replaceable cylinders. The varnishing roller is able to travel vertically, while the printing rollers are exchanged along a horizontal line, using a single device for two rollers. The exchange of the rollers is not suitable for just changing a sleeve without changing the shaft of the roller; which makes the system unsuitable for large printing rollers. When running, the varnishing roller, the printing roller and the pressure roller are not aligned, and thus the force applied is dependent on the roller diameter, and some parasitic force will appear. The vertical arrangement causes the pressure to be dependent on the cylinder weight, and if some varnish drops accidentally from the varnish source, it will land on the support. Also, the idle position of the roller depends on the diameter of the roller in operation.

EP 0 611 240 discloses a printing unit, with interchangeable rollers, but where the roller to be changed is not the printing roller, but the anilox.

WO 2014/202255 discloses a printing unit with interchangeable rollers. The system required the change of the complete printing roller. The inking roller, the printing roller and the pressure roller are arranged in a triangular configuration.

WO 2015/166409 discloses a printing unit with interchangeable printing sleeves. The printing sleeve is inserted on a printing shaft. The resulting roller is brought into contact with a pressure cylinder and an inking roller in a triangular configuration. When varying the printing cylinder sleeve diameter, an ad hoc adaptation piece is used to control the printing pressure. There need to be adaptation pieces for each sleeve diameter.

EP 1221367 discloses a printing unit for a flexographic machine with central drum with interchangeable roller. The rollers are not aligned, and the system is not suitable for being extended with a second printing roller that would substitute itself with the first printing roller in an automated way, by changing the (second) printing roller while the first one is printing.

SUMMARY OF THE INVENTION

The invention discloses a printing unit designed to facilitate the change of the printing sleeves and designed for a whole set of printing cylinder diameters.

Another aspect of the invention discloses a system where a printing sleeve can be loaded into the printing unit while the printing unit is printing.

An objective of the invention is to provide a system to change the printing sleeve in a printing unit rapidly.

Another objective of the invention is to provide a printing unit accepting printing sleeves with a large variety of diameters.

Another objective of the invention is to provide a method to avoid too much waste of support in a job change thanks to the automated loading of printing sleeves.

Another objective of the invention is to overcome the limitations of the prior art.

Another objective of the invention is to provide a printing unit whose control of the pressure applied to the printing roller, the inking roller and the pressure roller does neither depend on the printing diameter, nor on the roller weight.

These objectives are fulfilled by the invention as disclosed in the claims.

LIST OF FIGURES

Exemplary embodiments of the present invention are illustrated by way of example in the accompanying drawings.

Figure 5:
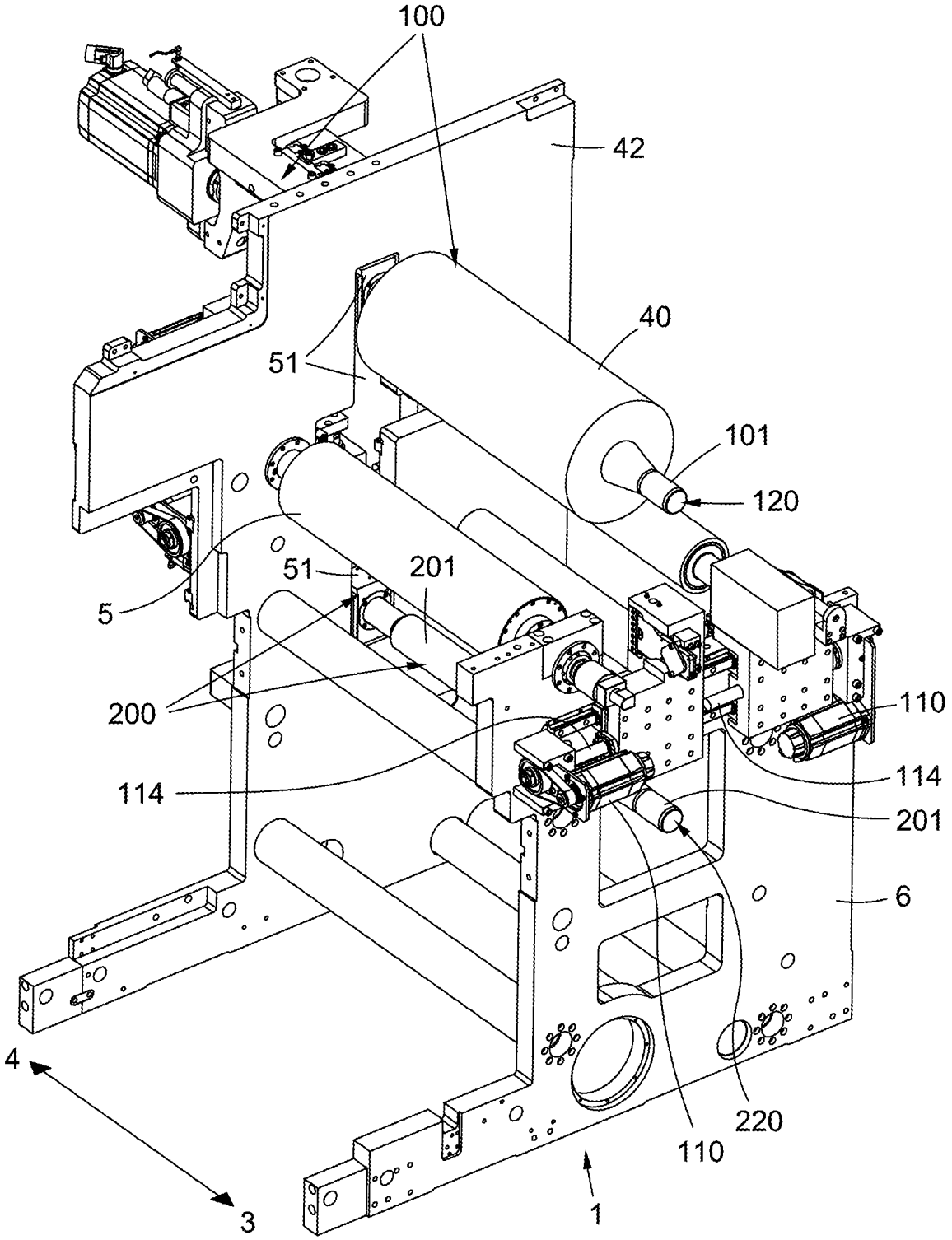

FIG. 5 shows the printing unit from the operator side. The printing sleeve is mounted on the first printing shaft, and the second printing shaft is empty. Both shafts are in their respective idle positions.

Figure 6:
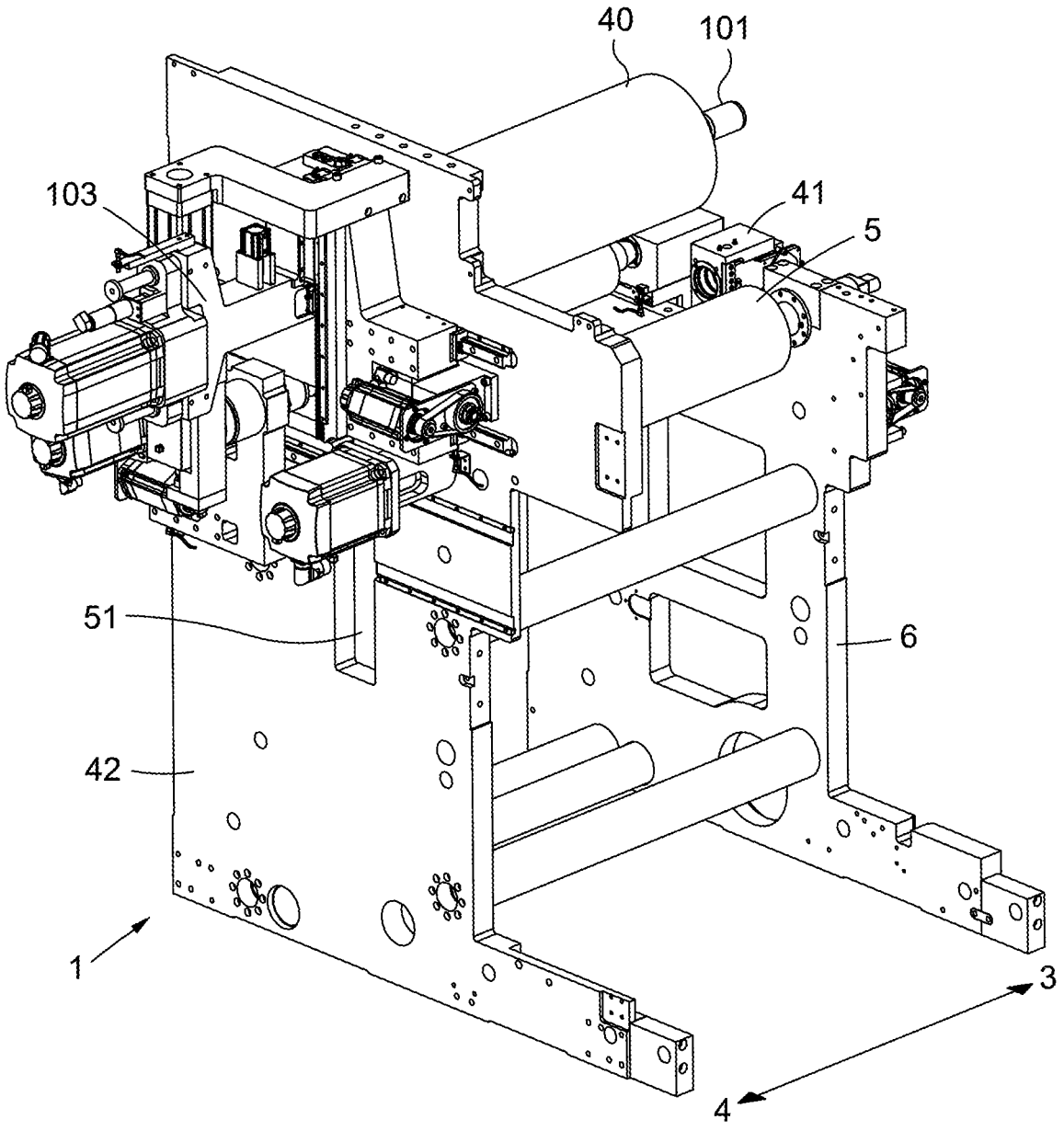

FIG. 6 shows the printing unit from the gear side with the second printing roller system missing.

Figure 7:
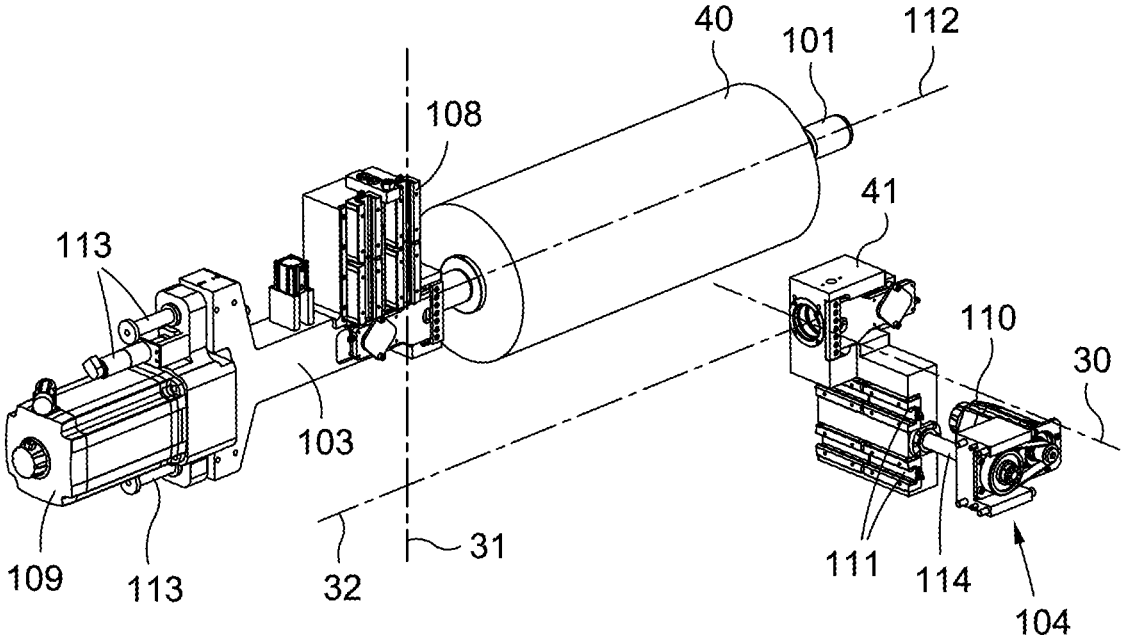

FIG. 7 shows an isolated view of the printing roller system with the bearing and the translation device for longitudinal translation.

Figure 8:
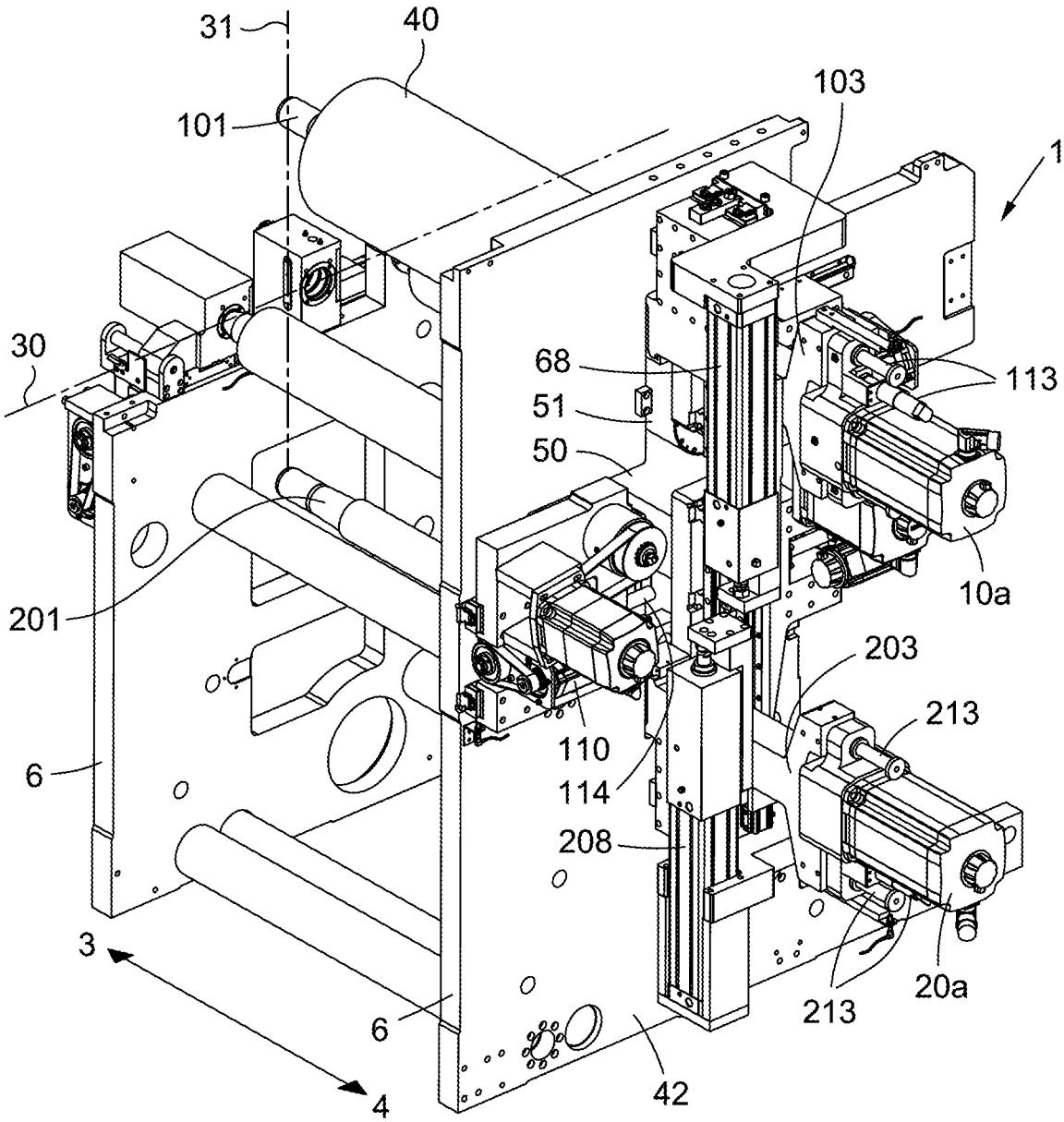

FIG. 8 shows the printing unit from the gear side, mounted with both printing roller systems.

DETAILED DESCRIPTION OF THE INVENTION AND OF SOME OF ITS EMBODIMENTS

This section describes in details some possible variations for implementing the invention followed by specific examples of embodiments. Unless stated otherwise, the features disclosed in distinct paragraphs may be used in distinct embodiments. For example, an embodiment comprising a feature disclosed in a paragraph can be used without the feature disclosed in the next paragraph. Nevertheless, the features disclosed in distinct paragraphs may also be used in combination with the features disclosed in other paragraphs.

The printing unit 1 comprises a frame 6, whose function is to hold the various rollers and gearing systems. A pressure roller 5 is fixed to the frame, preferably at a fixed location. The frame 6 and the unit 1 have an operator side 3, where the operator can routinely access the machine to perform, for example, a change of printing sleeve 40. The frame 6 and the unit 1 have a gear side 4, which is located on the opposite side of the frame or unit compared to the operator side 3. Most of the motors, actuators or pistons that run the printing unit are located on the gear side of the unit.

The printing unit 1 can be mounted either with one printing roller system 100 or with two printing roller systems 100,200. When using two printing roller systems, it is possible to change the printing sleeve 40 of one of the printing roller systems, while the printing unit is running with the other printing roller system, resulting in a faster change-over time. However, a unit with two printing roller systems is more expensive than a unit with one printing roller system. The unit 1 according to this invention can be mounted with a single roller system, and in a second time be mounted with an additional printing roller system. This staged mounting allows to spread the cost of the machine over time, by buying a machine with printing units mounted with only one printing roller system, and whenever the need for efficiency increases, buying at a later time the second printing roller systems. Another (not preferred) alternative, described at the end of the description uses only one printing roller system, is unable to accept two roller systems, is cheaper to build, and has as well the ability to accept—to some extent—a large variety of printing sleeves diameters. The printing unit according to this invention is particularly well suited for an in-line printing machine. In an inline printing unit, the pressure roller 5 has a diameter smaller than 2 m, usually smaller than 1 m and sometimes smaller than 50 cm.

Figure 1:
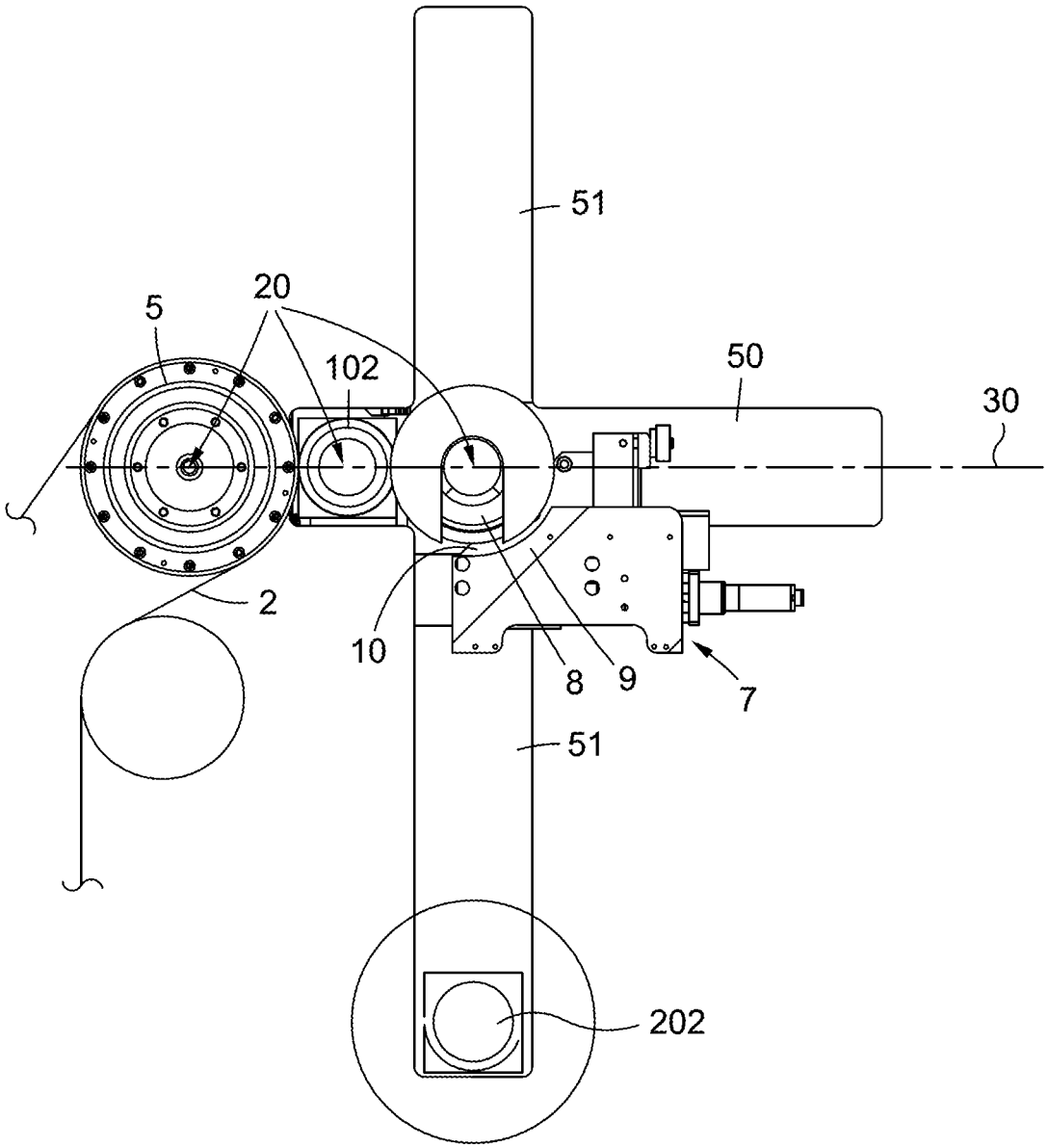
FIG. 1 shows a front view of the printing, inking and pressure roller in a running configuration. It uses a small printing roller.
Figure 2:
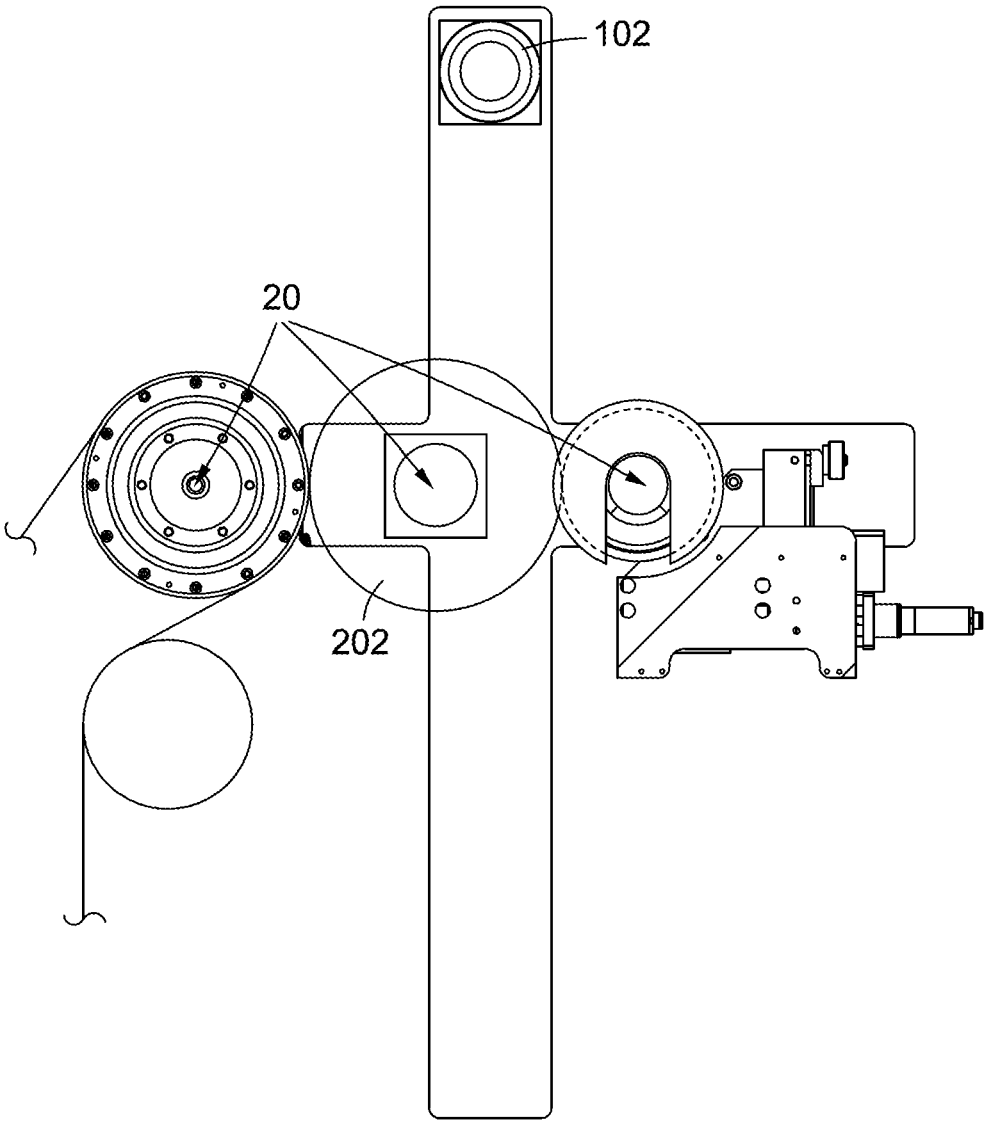
FIG. 2 shows a front view of the printing, inking and pressure roller in a running configuration. It uses a large printing roller.
Figure 3:
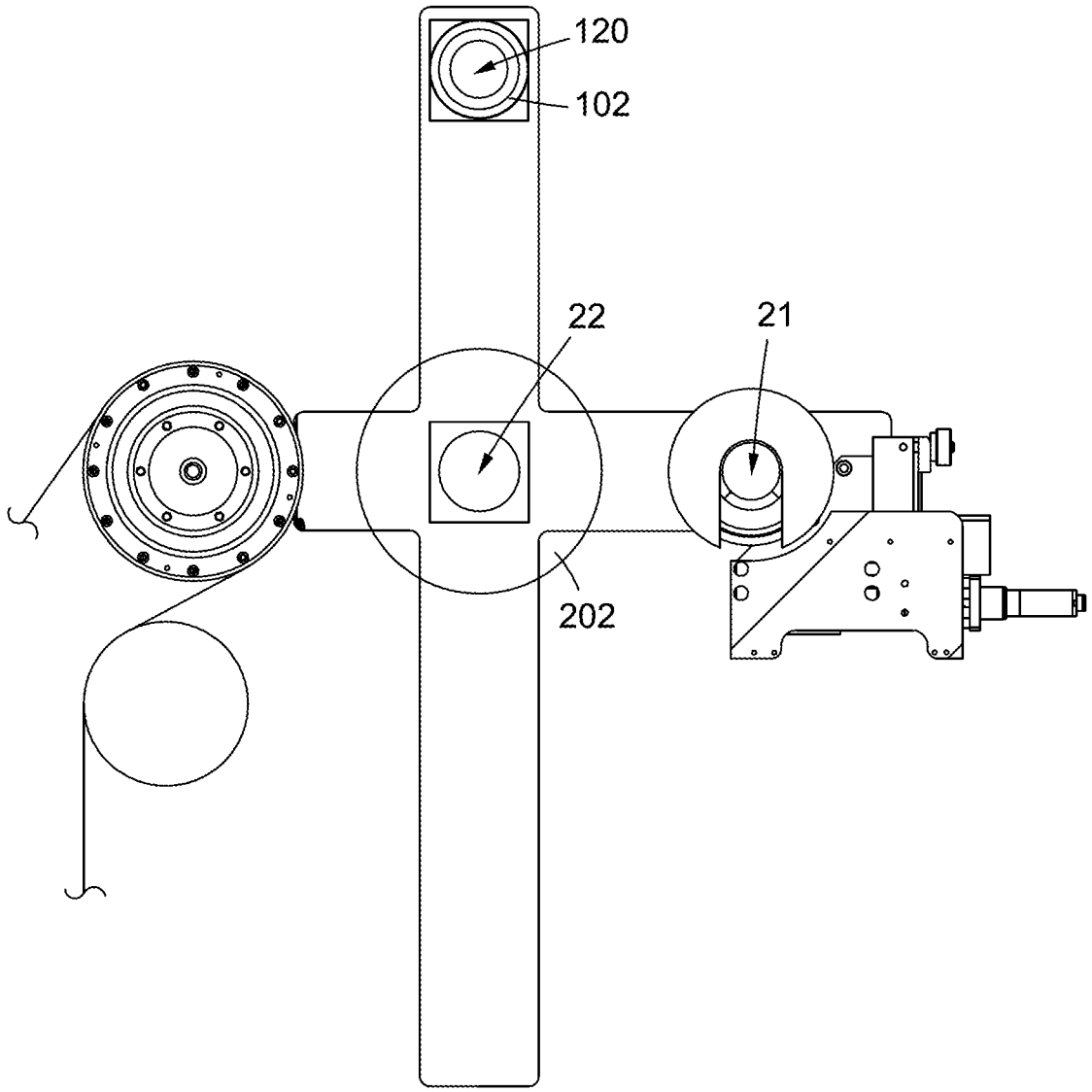
FIG. 3 shows a front view of the printing, inking and pressure roller, with the first printing roller in the first idle position and the second printing roller in the intermediate position.
Figure 4:
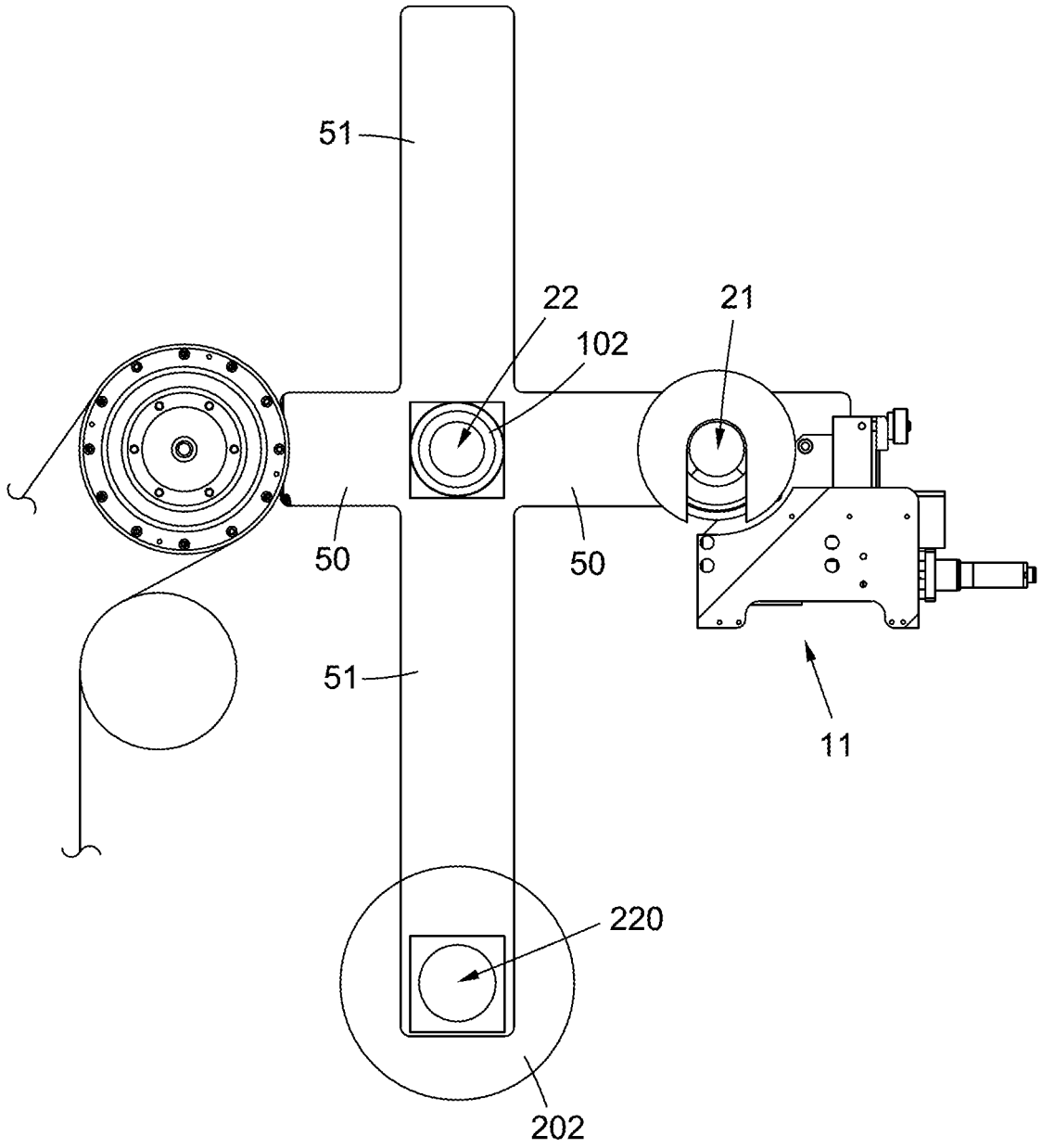
FIG. 4 shows a front view of the printing, inking and pressure roller, with the second printing roller in the second idle position and the first printing roller in the intermediate position.

When running, the printing roller 102,202 is positioned against the pressure roller 5, while the inking roller is positioned against the printing roller. The printing support 2 is pinched between the pressure roller 5 and the printing roller 102. Said three rollers have their rotation axis spread along a straight line, the longitudinal line 30, as shown in FIGS. 1 and 2. In other words, said three axes are comprised in a single plane. This configuration is defined as the running configuration of the printing unit. By definition, in the running configuration, each roller that takes part of the running printing job is in its running position 20, as depicted in FIGS. 1 and 2. When controlling the rollers with pressure (offset or rotogravure printing), aligning the rollers in this way results in a direct effect of the pressure applied on the roller shafts to the point of contact between the rollers. In contrast, if the axis would not be aligned, for example in the triangular setup used in the state-of-the-art, applying pressure along the longitudinal line would result in a force at the contact point between the rollers having a component along the perpendicular direction of the longitudinal line, resulting in a pressure force different from the one applied to the shaft. The difference in the force magnitude depends on the angles of the triangular configuration, and thus depends on the roller diameter. It is, therefore, advantageous to spread the three roller axes along a single line. In the aligned configuration, the pressure applied by the inking roller to the printing roller simply adds up to the pressure applied by the printing roller 102 (through the printing roller shaft 101) to the pressure roller 5. When using flexographic printing, the pressure is controlled by positioning the rollers (and preventing them to translate); the pressure being determined by the elasticity of the cliché and the elasticity of the pressure roller. Using the aligned configuration allows to independently control the printing pressure, by positioning the printing roller, and the inking pressure, by positioning the inking roller. It also provides a better positioning precision.

A typical diameter for a printing sleeve for a unit according to the invention ranges between 10 and 42 inches. Also, a typical inking roller diameter ranges between 9 and 20 inches. A pressure roller with a diameter of approximately 30 cm is well adapted for this range of printing roller diameters.

Advantageously, the longitudinal line 30 can be chosen as being horizontal, as shown for example in FIG. 1. In this configuration, the weight of the rollers do not influence the pressure at the contact point of the rollers; the force of gravity being perpendicular to the pressure force. This setup simplifies the control of the printing pressure in the printing unit 1 and improves the printing precision.

The printing roller 102 is made of a printing shaft 101 configured to carry a printing sleeve 40. The printing shaft is attached as a cantilever on a printing shaft support 103 which is attached on the gear side 4 of the frame 6 (through some translation devices). Thus, the printing shaft 101 protrudes from the frame gear side 4 toward the operator side 3, making the insertion and removal of the sleeve 40 convenient. The shaft is able to rotate along its rotation axis. The rotation is controlled by a motor 109, preferably located on the gear side of the frame.

Please note that the printing unit may comprise two printing roller systems: the first printing roller system 100 and the second printing roller system 200. A printing roller system comprises a printing shaft and a printing shaft support. When the printing unit is running, a printing sleeve 40 is mounted on the printing shaft and is integral in rotation with the printing shaft. The printing shaft and the sleeve 40 define a printing roller. These two systems are interchangeable in the sense that properties or behaviours described for one of the systems are also valid for the other system. Also, these two systems are made with the same type of components. When referring interchangeably to either the first printing system 100 or to the second printing system 200 (or to both) or to any of its sub-components, we omit the keyword "first" or "second" in the description.

The ink supplying module 7 comprises an inking roller 8 and a device for wetting the inking roller with ink 10. In flexographic printing units, the inking roller is an anilox. The ink supplying module is mounted on a translation device called the inking translation device 11. This device is able to translate the ink supplying module 7 along the longitudinal line 30. The translation goes from the running position 20 of the ink supplying module to a parking position 21, and vice versa. It allows separating the inking module from the printing roller 102,202 when undergoing a job change. The parking position is chosen to allow the printing module to move, and the printing sleeve 40 to be replaced without interfering, i.e. without coming into contact with the ink supplying module 7. The inking translation device sets the ink supplying module out of the way during a job change, and may also be used to control the position and/or pressure applied by the inking roller 5 to the printing roller 102,202 when the printing unit is running. In particular, when the ink supplying module 7 is positioned at the parking position 21, the printing roller 102,202 can be translated from the running position 20 to the intermediate position 22 and from the intermediate position 22 to the idle position 120,220 without coming into contact with the ink 10 carried by the ink supplying module 7.

The printing roller 102,202 is held by a shaft support 103,203 at the gear side 4 and by a bearing 41 at the operator side 3. The printing roller is able to rotate inside the shaft support and inside the bearing 41. The printing roller and the bearing 41 are able to translate along the longitudinal line 30. The bearing 41 ensures a precise and stable positioning of the printing shaft 101,201 on the operator side 3 of the frame 6. The precise positioning of the printing shaft 101, 201 on the gear side 4 of the frame 6 is controlled thanks to the shaft support 103,203. The running position 20 of the printing roller system 100,200 is variable, depending on the diameter of the printing roller 103,203, as can be seen by comparing FIG. 1 with FIG. 2. Advantageously, the bearing 41 is configured to translate from the running position defined by the smallest acceptable printing roller to an intermediate position 22. The bearing must be able to translate at least from the running position defined by the smallest acceptable printing roller to the running position defined by the largest acceptable printing roller (plus some margin to set the largest acceptable printing roller out of contact with the pressure roller). The printing roller system 100,200 is translated by a longitudinal translation device 104,204 configured to translate the printing roller system from its running position 20 to an intermediate position 22. Advantageously, the longitudinal translation device comprises an electric motor 110 and a linear guide 111. The longitudinal translation device is located at the gear side 4 of the frame 6. Thus, the motor can also be used to control the position or pressure between the printing roller and the pressure roller 5 in running position 20. A similar translation device may advantageously be employed to translate the bearing 41, and also to control the position or pressure between the printing roller and the pressure roller when the printing roller is engaged in the bearing 41 and in the running position 20.

To perform a job change, the printing roller is moved from its running position 20 to an idle position 120,220. The idle position is adapted for the replacement of the printing sleeve 40. To reach the idle position, the printing roller is first translated alongside the longitudinal line toward and intermediate position 22 and then translated, alongside an elevation path 31, toward the idle position 120,220. The longitudinal line is perpendicular to the rotation axes of the printing 102,202, the inking 8 and the pressure 5 rollers. Preferably, the elevation path is located in a plane which is also perpendicular to said rotation axes (in any cases, the elevation path is not parallel to said axis). There is at least one idle position, but preferably two. In the idle position, there is enough space to replace the printing sleeve 40, either thanks to an opening in the frame 6 on the operator side 3 or because the idle position is above the frame border on the operator side 3.

To be able to travel along the elevation path, the printing roller system 100,200 must be disengaged from the bearing 41. The disengagement is performed by moving the printing roller toward the gear side 4 of the frame along the transversal line. This allows the printing roller shaft to have a free end at the operator side 3 of printing unit 1, to be able to replace the printing sleeve 40. It also has the advantage to limit the motion of the bearing to a translation along the longitudinal line, and thus provide a more rigid printing module (compared to a situation where the bearing would also move transversally). The disengaging of the printing roller shaft can be done anywhere between the running position 20 and the intermediate location 22, or while translating the printing roller along the longitudinal line.

A transversal translation device 113,213 is used to engage and disengage the printing roller shaft 101,201 into and away from the bearing 41, alongside a transversal line 32. The transversal line 32 is parallel to the rotations axis of the printing roller and crosses the longitudinal line 30. In an embodiment using a single elevation device 108 for two printing roller systems, a single transversal translation device can be used to operate both printing roller systems. In embodiments with two elevation devices 108 and 208, a first transversal translation device 113 is provided to operate the first printing roller system 100 and a second transversal translation device 213 is used to operate the second printing roller system 200. The transversal translation device translates the printing shaft along the transversal line 32 toward the operator side 3 to engage the printing shaft into the bearing 41. The transversal translation device translates the printing shaft along the transversal line 32 toward the gear side 4 to disengage the printing shaft from the bearing 41.

Because in a high quality press the transversal translation is also used for the lateral register, it is preferably performed by a motor with ball screws. This motor serves the purpose of the lateral register and of disengaging the printing roller from the bearing 41. A lateral register being used to fine tune the lateral printing position in real time during printing according to some alignment marks on the support.

The elevation device 108 is used to translate the printing roller system 100 from the intermediate position to the idle position 120, alongside the elevation path 31. Advantageously, the elevation path 31 is a (straight) line. The elevation path is oriented differently from the longitudinal line to put some distance between the printing roller system and the longitudinal line. This serves two functions: one the one hand, it allows to place the printing roller system 100 in a convenient location for replacing the printing sleeve (i.e. the idle position), on the other hand, it frees the space on the longitudinal line to insert a second printing roller system 200 while the first roller system 100 undergoes the sleeve change. The elevation path makes an angle comprised between 45 degrees and 135 degrees with the longitudinal line. The exact angle has to be chosen according to the placement of the other subsystems of the printing unit and according to the path of printing support 2. As an alternative, the elevation path could be split into two paths, one above the longitudinal line, making a first angle with the longitudinal line (comprised between 45 degrees and 135 degrees) the other below the longitudinal line and making a second angle with the longitudinal line (comprised between 45 degrees and 135 degrees). As another alternative, the elevation path can be an arc, and the elevation device a motor, or a piston operating on a mechanical arm holding the printing roller system and articulated around the centre of the arc. In the (preferred) embodiments where the elevation path is an elevation line, the elevation device is a translation device. In another alternative, the elevation path could be split into two paths, both being above (or below) the longitudinal line.

Advantageously, the elevation path can be a vertical line. Advantageously, the elevation path is perpendicular to the longitudinal line.

An elevation device 108 is used to translate the printing roller system 100 from the intermediate position 22 to the idle position 120 and vice versa. When using a printing unit with two printing roller systems 100,200, there are two alternatives to implementing the elevation device. The first (preferred) alternative uses a first elevation device 108 for the first printing roller system 100 and a second elevation device 208 for the second printing roller system 200. The other alternative uses a single elevation device 108 for operating both printing roller systems. In the latter case, when the first printing roller system is moved from the intermediate position 22 to the idle position 120 along the elevation path 31, then the second printing roller system 200 is simultaneously moved from the idle position 220 to the intermediate position 22. Also, in the latter case, when one of the printing systems is translated alongside the longitudinal line 30, the other will be translated along a parallel to the longitudinal line, which transforms the idle position in a locus of idle positions parallel to the longitudinal line. Thus, the idle position is then dependent on the diameter of the printing roller system in operation (which might be a disadvantage if the printing sleeve has to be changed by a robot, but is an advantage in terms of costs). The use of a single elevation device does not preclude the possibility to provide a system with only one printing roller system 100 to be completed in a later time by a second printing roller system.

The translation devices may comprise an electric motor 110 and linear guides positioned along the line. In particular, they can be advantageously implemented using a carriage 111 running on a rail. The carriage comprises an internal thread, traversed by a screw 114 whose rotation is controlled by the motor. A ball screw could be conveniently used to reduce friction. The translation devices using an electric motor has the advantage of a good positioning precision at any point of the translation. Electric motors are the preferred embodiments for translation devices that operate along the longitudinal axis in a flexographic printing unit.

As an alternative, hydraulic or air operated pistons can be used instead of electric motors as translation devices. The hydraulic or air operated pistons are cheaper and more reliable over time than translation devices operated by motors. However, they are used in translation motions with at most two stop positions. Pistons cannot be used for precise positioning between these two stop positions. Pistons are the preferred embodiment for translation devices along the elevation axis. In addition to the pistons, a mechanical or hydraulic lock can advantageously be used to lock the position of the printing roller at one of the ends of the elevation path (on the longitudinal line) to avoid spurious motions or vibrations along the elevation path.

The translation devices operating along the longitudinal have to position the printing roller and the inking roller in the running position 20. The printing pressure in a flexographic machine is controlled by a precise relative positioning of the printing roller with respect to the pressure roller. The pressure is then determined by the elasticity of the cliché (Plate) and of the pressure roller. When using electric motor driven translation device, this positioning can be provided by a simple control of the motor, making this embodiment the preferred one. When using piston-driven translation devices, a stopping element must be provided that stops the printing roller and the inking roller in the running positions. Since these positions depend on the printing roller diameter, an ad hoc element for each printing roller diameter must be provided.

The translation devices are advantageously mounted in series, on the gear side 4 of the frame 6, which implies that when the printing roller system translates along the longitudinal line, the elevation device and the transversal translation device simultaneously translate following a parallel to the longitudinal line with the longitudinal translation device. Also, when the elevation device displaces the printing roller system along the elevation path, the transversal translation device is also displaced along a parallel to the elevation.

To be as rigid as possible, the frame 6 may comprise a wall 42. The wall 42 comprises two slots to allow the motion of the printing roller systems along the longitudinal line 30 and along the elevation path 31. The first slot 50 is parallel to (and at the same height than) the longitudinal line 30. The second slot 51 is parallel to (and at the same height than) the elevation path 31. The slots allow the printing roller shaft to cross the wall 42. The longitudinal translation device, the elevation device and the transversal translation device may advantageously be located behind the wall 42, i.e. on the gear side of the wall. The printing sleeve 40 is mounted on the operator side 3 of the wall 42 by the operator.

To replace a sleeve for a job change, the implemented method is as follow: we assume the printing unit is in a running configuration, using a single printing roller system, with the printing roller system 100 in the running position 20. The method comprises the steps of Translating the ink supplying module 7 from the running position 20 to the parking position 21;

Translating the first printing roller system 100 from the running position 20 to the intermediate position 22;

Disengaging the first printing shaft 101 from the bearing 41;

(the above-mentioned steps may be run in parallel or in sequence)

then

Translating the first printing roller system 100 from the intermediate position 22 to the idle position 120; then Replacing the printing sleeve 40; then Translating the first printing roller system 100 from the idle position 120 back to the intermediate position 22; then Engaging the printing shaft 101 into the bearing 41;

Translating the first printing roller system 100 from the intermediate position 22 to the running position 20;

Translating the ink supplying module 7 from the parking position 21 to the running position 20.

To replace a sleeve for a job change, in a unit with a two printing roller system installed, the implemented method is as follow: we assume the printing unit is in a running configuration, with the first printing roller system 100 in the running position 20. The method comprises the steps of Mounting a sleeve 40 on the second printing roller system 200 while the first printing roller system 100 is in the running position 20;

Translating the ink supplying module 7 from the running position 20 to the parking position;

Translating the first printing roller system 100 and the bearing 41 from the running position 20 to the intermediate position 22;

Disengaging the first printing shaft 101 from the bearing 41; then

Translating the first printing roller system 100 from the intermediate position 22 to the first idle position 120;

Translating the second printing roller system 200 from the second idle position 220 to the intermediate position 22 (i.e. these two phases may happen simultaneously); then Engaging the second printing shaft 201 into the bearing 41;

Translating the second printing roller system 200 from the intermediate position 22 to the running position 20;

Translating the ink supplying module 7 from the parking position 21 to the running position 20.

Another embodiment of the printing unit according to the invention uses only one printing roller system and avoids the use of the elevation device. To change the sleeve, the roller system is translated along the longitudinal line (and disengaged from the bearing 41) until it reaches a location where the sleeve can be exchanged. As in the other embodiments, the printing roller shaft 101 is held by the printing shaft support 103 in a cantilever configuration, which is convenient for slipping and unslipping the sleeve 40 over the shaft 101 from the operator side 3. The inking roller 8 also translates along the longitudinal line 30 up to a parking position 21, which is located further on the longitudinal line, so as to avoid interfering with the sleeve change. This embodiment has similar advantages to the ones described here except that it cannot be mounted with two printing rollers systems, and thus requires a longer changeover time. Nevertheless, by avoiding the need of the elevation device, it results in a cheaper system while preserving the print quality. In this embodiment, the inking translation device 11 must be designed to avoid interfering with the sleeve change and might limit the range of possible sleeve diameters.

Please note that when writing that a roller system translates along the line, it means that there exist one point on the rotation axis of the roller that moves along said line. By line, we mean a straight line. The angle between a line and a path is measured as the angle between the line and the tangent to the path at the intersection between the path and the line. In the method claims, the chronological order of the steps of a process is defined when the steps, or group of steps, are separated by the word "then".

LIST OF NUMBERED ELEMENTS the printing unit 1
printing support 2
operator side 3
gear side 4
pressure roller 5
frame 6
ink supplying module 7
inking roller 8
device for wetting the inking roller 9
ink 10
Inking translation device 11
running position 20
parking position 21
intermediate position 22
first idle position 120
second idle position 220
longitudinal line 30
elevation path 31
transversal line 32
first printing roller system 100
first printing shaft 101
first printing roller 102
first printing shaft support 103
first longitudinal translation device 104
first elevation device 108
The rotation axis of the first printing roller 112
A first transversal translation device 113
printing sleeve 40
bearing 41
wall 42
first slot 50
second slot 51
second printing roller system 200
second printing shaft 201
second printing roller 202
second printing shaft support 203
second longitudinal translation device 204
second elevation device 208
the rotation axis of the second printing roller 212
second transversal translation device 213

The invention claimed is:

1. A printing unit having an operator side and a gear side at an opposite side of the operator side, the printing unit comprising:

a frame comprising a wall comprising a first slot and a second slot, the wall defining the operator side and the gear side;

a pressure roller provided on the operator side of the printing unit and having a rotation axis extending transverse to the wall;

an ink supplying module comprising an inking roller, the inking roller provided on the operator side of the printing unit and having a rotation axis extending transverse to the wall;

an inking translation device for translating the ink supplying module along a longitudinal line;

a first printing roller system including:

a first printing shaft passing through one or more of the first slot or the second slot in the wall and having a rotation axis extending transverse to the wall, the first printing shaft configured to hold a printing sleeve on the operator side of the printing unit and defining a first printing roller when the printing sleeve is mounted on the first printing shaft; and a first printing shaft support configured to hold the first printing shaft as a cantilever from the gear side of the printing unit;

wherein the first printing roller system is configured to allow the printing sleeve to be replaced from the operator side of the printing unit; and a first longitudinal translation device provided on the gear side of the printing unit and configured to translate the first printing roller system through the first slot in the wall along the longitudinal line; and a first elevation device provided on the gear side of the printing unit and configured to translate the first printing roller system through the second slot in the wall along an elevation path oriented differently than the longitudinal line; and wherein the rotation axis of the first printing roller is perpendicular to the longitudinal line; and when the printing unit is printing with the printing sleeve mounted on the first printing shaft, the first printing roller is positioned against the pressure roller and against the inking roller, respective rotation axes of the first printing, pressure, and inking rollers are parallel and distributed along the longitudinal line.

2. The printing unit according to claim 1, wherein the first longitudinal translation device is suitable for translating the first printing roller from a running position to an intermediate position and vice-versa; and the inking translation device is suitable for translating the ink supplying module from a running position to a parking position and vice-versa;

wherein the running positions of the first printing roller and the inking roller are defined as respective positions of the first printing roller and the inking roller when the printing unit is printing;

wherein the printing unit further comprises:

the first elevation device is suitable for translating the first printing roller system from the intermediate position to a first idle position and vice-versa;

wherein when the first printing roller system is in the first idle position, the first printing roller system is configured to allow the printing sleeve to be removed from the first printing shaft from the operator side of the printing unit and replaced by another printing sleeve.

3. The printing unit according to claim 2, further comprising:

a bearing arranged to translate according to the longitudinal line on the operator side of the printing unit; and a first transversal translation device for sliding the first printing shaft into the bearing and removing the first printing shaft from the bearing alongside a transversal line parallel to the rotation axis of the first printing shaft.

4. The printing unit according to claim 3, wherein the first slot being parallel to the longitudinal line;

the second slot being parallel to the elevation path;

the first elevation device, the first transversal translation device, and the first longitudinal translation device being located on the gear side of the printing unit; and the printing sleeve being mountable on the operator side of the printing unit.

5. The printing unit according to claim 3, further comprising a second printing roller system comprising:

a second printing shaft suitable for holding a printing sleeve and defining a second printing roller when the printing sleeve is mounted on the second printing shaft; and a second printing shaft support configured to hold the second printing shaft as a cantilever from the gear side of the printing unit, wherein, when the second printing roller is in a second idle position, the printing sleeve is removable from the second printing shaft from the operator side of the printing unit and replaced by another printing sleeve.

6. The printing unit according to claim 5, further comprising:

a second elevation device configured to translate the second printing roller system from the intermediate position to a second idle position and vice-versa along an elevation path, wherein the first and the second idle positions are located on opposite sides of the intermediate position along the elevation path.

7. The printing unit according to claim 2, wherein an angle between the longitudinal line and the elevation path is between 45 degrees and 135 degrees.

8. The printing unit according to claim 2, wherein the longitudinal line is perpendicular to the elevation path.

9. The printing unit according to claim 2, wherein the elevation path is vertical.

10. The printing unit according to claim 2, wherein, when the ink supplying module is positioned in the parking position, the first printing roller is movable from the running position to the intermediate position and from the intermediate position to the first idle position without coming into contact with the ink carried by the ink supplying module.

11. The printing unit according to claim 2, wherein the elevation path is comprised in a plane, which is perpendicular to the rotation axis of the first printing roller.

12. The printing unit according to claim 1, wherein the longitudinal line is horizontal.

13. The printing unit according to claim 1, wherein a ratio of a diameter of the pressure roller to a diameter of the printing sleeve is approximately 1 to 1.

14. The printing unit according to claim 1, wherein a ratio of a diameter of the pressure roller to a diameter of the printing sleeve is less than 2 to 1.

15. The printing unit according to claim 1, wherein a ratio of a diameter of the pressure roller to a diameter of the printing sleeve is less than 3 to 1.

16. The printing unit according to claim 1, wherein a diameter of the pressure roller is smaller than a diameter of the printing sleeve.

17. A method for replacing a printing sleeve for the printing unit according to claim 3 in a running configuration, the method comprising:

translating the ink supplying module from the running position to the parking position;

translating the first printing roller system from the running position to the intermediate position;

disengaging the first printing shaft from the bearing;

translating the first printing roller system from the intermediate position to the idle position;

translating the first printing roller system from the idle position back to the intermediate position;

engaging the first printing shaft into the bearing;

translating the first printing roller system from the intermediate position to the running position; and translating the ink supplying module from the parking position to the running position.

18. A method for replacing a printing sleeve for the printing unit according to claim 5, the method comprising:

receiving a printing sleeve on the second printing roller system while the first printing roller system is in the running position;

translating the ink supplying module from the running position to the parking position;

translating the first printing roller system and the bearing from the running position to the intermediate position;

disengaging the first printing shaft from the bearing;

translating the first printing roller system from the intermediate position to the first idle position;

translating the second printing roller system from the second idle position to the intermediate position;

engaging the second printing shaft into the bearing;

translating the second printing roller system from the intermediate position to the running position; and translating the ink supplying module from the parking position to the running position.

19. A printing unit for a flexographic printing machine having an operator side and a gear side at an opposite side of the operator side, the printing unit comprising:

a frame comprising a wall comprising a first slot and a second slot, the wall defining the operator side and the gear side;

a pressure roller provided on the operator side of the printing unit and having a rotation axis extending transverse to the wall;

an ink supplying module comprising an inking roller, the inking roller provided on the operator side of the printing unit and having a rotation axis extending transverse to the wall;

an inking translation device for translating the ink supplying module along a longitudinal line from a running position to a parking position and vice-versa;

a first printing roller system including a first printing shaft passing through one or more of the first slot or the second slot in the wall and having a rotation axis extending transverse to the wall, the first printing shaft configured to hold a printing sleeve on the operator side of the printing unit and defining a first printing roller when the printing sleeve is mounted on the first printing shaft, and a first printing shaft support configured to hold the first printing shaft as a cantilever from the gear side of the printing unit;

a first longitudinal translation device provided on the gear side of the printing unit and configured to translate the first printing roller system through the first slot in the wall along the longitudinal line from a running position to an intermediate position and vice-versa; and a first elevation device provided on the gear side of the printing unit and configured to translate the first printing roller system through the second slot in the wall along an elevation path, oriented differently than the longitudinal line, for translating the first printing roller system from the intermediate position to a first idle position and vice-versa, wherein the first printing roller system is configured to allow the printing sleeve to be removed from the first printing shaft from the operator side of the printing unit and replaced by another printing sleeve when the first printing roller system is in the first idle position.

20. A printing unit for a flexographic printing machine having an operator side and a gear side at an opposite side of the operator side, the printing unit comprising:

a frame comprising a wall comprising a first slot and a second slot, the wall defining the operator side and the gear side;

a pressure roller provided on the operator side of the printing unit and having a rotation axis extending transverse to the wall;

an ink supplying module comprising an inking roller, the inking roller provided on the operator side of the printing unit and having a rotation axis extending transverse to the wall;

an inking translation device for translating the ink supplying module along a longitudinal line;

a first printing roller system including:

a first printing shaft passing through one or more of the first slot or the second slot in the wall and having a rotation axis extending transverse to the wall, the first printing shaft configured to hold a printing sleeve on the operator side of the printing unit and defining a first printing roller when the printing sleeve is mounted on the first printing shaft; and a first printing shaft support configured to hold the first printing shaft as a cantilever from the gear side of the printing unit;

wherein the first printing roller system is configured to allow the printing sleeve to be replaced from the operator side;

a first longitudinal translation device provided on the gear side of the printing unit and configured to translate the first printing roller system through the first slot in the wall along the longitudinal line; and a first elevation device provided on the gear side of the printing unit and configured to translate the first printing roller system through the second slot in the wall along an elevation path oriented differently than the longitudinal line; and wherein a rotation axis of the first printing roller is perpendicular to the longitudinal line, when the printing unit is printing with the printing sleeve mounted on the first printing shaft, the first printing roller is positioned against the pressure roller and against the inking roller, respective rotation axes of the printing, pressure, and inking rollers are parallel and distributed along the longitudinal line, the first longitudinal translation device is suitable for translating the first printing roller from a running position to an intermediate position and vice-versa, the inking translation device is suitable for translating the ink supplying module from a running position to a parking position and vice-versa the running positions of the first printing roller and the inking roller are defined as respective positions of the first printing roller and the inking roller when the printing unit is printing;

wherein the first elevation device is suitable for translating the first printing roller system from the intermediate position to a first idle position and vice-versa;

wherein when the first printing roller system is in the first idle position, the first printing roller system is configured to allow the printing sleeve to be removed from the first printing shaft from the operator side of the printing unit and replaced by another printing sleeve.

* * * * *